US011158178B2

(12) United States Patent
Anzziani

(10) Patent No.: US 11,158,178 B2
(45) Date of Patent: Oct. 26, 2021

(54) USER INTERFACE FOR NETWORK CAPABLE SMOKE DETECTOR

(71) Applicant: Carrier Corporation, Palm Beach Gardens, FL (US)

(72) Inventor: Gabriel Anzziani, Bradenton, FL (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/255,187

(22) PCT Filed: Dec. 10, 2019

(86) PCT No.: PCT/US2019/065400
§ 371 (c)(1),
(2) Date: Dec. 22, 2020

(87) PCT Pub. No.: WO2020/123462
PCT Pub. Date: Jun. 18, 2020

(65) Prior Publication Data

US 2021/0209916 A1 Jul. 8, 2021

Related U.S. Application Data

(60) Provisional application No. 62/778,548, filed on Dec. 12, 2018.

(51) Int. Cl.
*G08B 17/10* (2006.01)
*G08B 3/10* (2006.01)
(Continued)

(52) U.S. Cl.
CPC ..... *G08B 17/10* (2013.01); *G08B 3/10* (2013.01); *G08B 5/38* (2013.01); *G08B 27/005* (2013.01); *G08B 29/20* (2013.01)

(58) Field of Classification Search
CPC . G08B 17/10; G08B 3/10; G08B 5/38; G08B 27/005; G08B 29/20
(Continued)

(56) References Cited

U.S. PATENT DOCUMENTS 6,348,871 B1 * 2/2002 Tanguay ..... G08B 29/145 340/514
9,454,893 B1 * 9/2016 Warren ..... G08B 17/10
(Continued)

FOREIGN PATENT DOCUMENTS

EP 2264681 A1 12/2010

OTHER PUBLICATIONS

International Search Report and Written Opinion for International Application No. PCT/US2019/065400, dated Jun. 25, 2020.
(Continued)

*Primary Examiner* — John A Tweel, Jr.
(74) *Attorney, Agent, or Firm* — Carlson, Gaskey & Olds, P.C.

(57) ABSTRACT

An example smoke detector includes a smoke detection circuit operable to detect smoke, a piezo buzzer, a single color visual indicator, and a transceiver operable to communicate with at least one other smoke detector. A processor is operatively connected to the smoke detection circuit, piezo buzzer, single color visual indicator, and transceiver. The processor is operable to provide distinct notifications for each of a plurality of modes of the smoke detector including at least one alarm mode that indicates detected smoke, at least one maintenance mode that indicates a maintenance condition of the smoke detector, and at least one network configuration mode. Each notification includes one or more audio tones from the piezo buzzer, one or more illuminations of the single color visual indicator, or a combination thereof.

20 Claims, 5 Drawing Sheets

(51) Int. Cl.
*G08B 27/00* (2006.01)
*G08B 29/20* (2006.01)
*G08B 5/38* (2006.01)

(58) Field of Classification Search
USPC ..... 340/286.01
See application file for complete search history.

(56) References Cited

U.S. PATENT DOCUMENTS

| | | | | |
|---|---|---|---|---|
| 10,078,943 | B2 * | 9/2018 | Feltham | G08B 5/38 |
| 10,078,959 | B2 * | 9/2018 | Rossi | G08B 5/36 |
| 2011/0025490 | A1 * | 2/2011 | Egawa | G08B 7/06<br>340/514 |
| 2016/0364977 | A1 * | 12/2016 | Warren | G08B 29/10 |
| 2018/0130315 | A1 | 5/2018 | Feltham et al. | |

OTHER PUBLICATIONS

International Preliminary Report on Patentability for International Application No. PCT/US2019/065400, dated Jun. 24, 2021.

* cited by examiner

USER INTERFACE FOR NETWORK CAPABLE SMOKE DETECTOR

CROSS-REFERENCE TO RELATED APPLICATIONS

This application claims priority to U.S. Provisional Application No. 62/778,548, which was filed on Dec. 12, 2018, and is incorporated by reference herein in its entirety.

BACKGROUND

This application relates to smoke detectors, and more particularly to a user interface for a smoke detector.

Traditionally, smoke detectors have been standalone devices that have included limited functionality, providing an audio notification according to the T3 temporal pattern (as defined by ANSI S3.41-1990) for a detected smoke condition, providing a short beep or "chirp" to indicate a low battery condition, and including a single button that served to initiate a "push to test" feature to test whether the smoke detection circuit and the sound-emitting device are operational. Smoke detection devices with enhanced feature sets have included correspondingly more complex user interfaces to accommodate the enhanced feature sets.

SUMMARY

A smoke detector according to an example of the present disclosure includes a smoke detection circuit operable to detect smoke, a piezo buzzer, a single color visual indicator, a transceiver operable to communicate with at least one other smoke detector, and a processor operatively connected to the smoke detection circuit, piezo buzzer, single color visual indicator, and transceiver. The processor is operable to provide distinct notifications for each of a plurality of modes of the smoke detector including at least one alarm mode that indicates detected smoke, at least one maintenance mode that indicates a maintenance condition of the smoke detector, and at least one network configuration mode. Each notification includes one or more audio tones from the piezo buzzer, one or more illuminations of the single color visual indicator, or a combination thereof.

In a further embodiment of any of the foregoing embodiments, different ones of the notifications utilize different intervals between successive audio tones, different intervals between successive illuminations of the single color visual indicator, or both.

In a further embodiment of any of the foregoing embodiments, the distinct notification corresponding to one of the at least one alarm modes indicates detection of smoke by either of the smoke detection circuit or the at least one other smoke detector.

In a further embodiment of any of the foregoing embodiments, a plurality of the distinct notifications include one or more sounds from the piezo buzzer, and the processor is configured to provide a respective pulse width modulated input signal to the piezo buzzer for each of a first subset of the plurality of distinct notifications, and provide a respective non-pulse width modulated input signal to the piezo buzzer for each of a second subset of the plurality of distinct notifications.

In a further embodiment of any of the foregoing embodiments, each non-pulse width modulated input signal having an "on" duration greater than a predefined threshold causes the piezo buzzer to emit a tone at a resonant frequency of the piezo buzzer, and each pulse width modulated input signal having a duty cycle less than the predefined threshold causes the piezo buzzer to emit one or more tones at a non-resonant frequency of the piezo buzzer.

In a further embodiment of any of the foregoing embodiments, one of the distinct notifications includes the piezo buzzer utilizing a pulse-width modulated input signal having a varying duty cycle and providing an audio notification that varies in tone or volume.

In a further embodiment of any of the foregoing embodiments, one of the distinct notifications includes the piezo buzzer utilizing a pulse-width modulated input signal and emitting three consecutive tones of increasing or decreasing pitch.

In a further embodiment of any of the foregoing embodiments, the smoke detector includes a button, and based on actuation of the button, the processor is configured to determine a type of actuation of the button, and perform one of a plurality of different predefined actions in response to the type of actuation and which mode the smoke detector is in when the actuation is detected.

In a further embodiment of any of the foregoing embodiments, the processor is configured to interpret a single continuous actuation of the button having a duration shorter than a predefined time period as a first type of actuation, interpret two successive actuations of the button within the predefined time period as a second type of actuation, and interpret a continuous actuation of the button having a duration longer than the predefined time period as a third type of actuation.

In a further embodiment of any of the foregoing embodiments, the processor is configured to interpret more than two actuations of the button within the predefined time period as the third type of actuation.

In a further embodiment of any of the foregoing embodiments, when the smoke detector is networked with the at least one other smoke detector in a network group, one of the smoke detectors in the network group is configured as a coordinator of the group that provides a beacon signal to other members of the network group, and the remaining smoke detectors in the group are configured as non-coordinators in the network group that monitor the beacon signal.

In a further embodiment of any of the foregoing embodiments, when the smoke detector is part of a network group and is in one of the network configuration modes, the processor is configured to provide a first one of the distinct notifications that indicates a quantity of smoke detectors that are members of the network group in response to a first type of actuation of the button, cause the smoke detector to become the coordinator of the network group and provide a second one of the distinct notifications that indicates that the smoke detector has become the coordinator in response to a second type of actuation of the button, and reset a network configuration of the smoke detector in response to a third type of actuation of the button.

In a further embodiment of any of the foregoing embodiments, the plurality of modes includes fatal and non-fatal fault modes in which the smoke detector provides one of the distinct notifications to indicate a fault condition.

In a further embodiment of any of the foregoing embodiments, in the fatal fault mode, a quantity of blinks of the light indicates a corresponding fault code of the smoke detector.

In a further embodiment of any of the foregoing embodiments, the plurality of modes includes a manufacturing mode in which the smoke detector provides one of the distinct notifications to indicate a status of a manufacturing calibration process of the smoke detector.

A smoke detector according to an example of the present disclosure includes a smoke detection circuit operable to detect smoke, a piezo buzzer, and a processor connected to the smoke detection circuit and piezo buzzer and operable to provide distinct notifications for each of a plurality of modes of the smoke detector, including at least one alarm mode that indicates detected smoke and at least one non-alarm mode. Each notification includes one or more audio tones from the piezo buzzer. The processor is configured to provide a respective pulse width modulated input signal to the piezo buzzer for each of a first subset of the plurality of distinct notifications, and provide a respective non-pulse width modulated input signal to the piezo buzzer for each of a second subset of the plurality of distinct notifications.

In a further embodiment of any of the foregoing embodiments, each non-pulse width modulated input signal having an "on" duration greater than a predefined threshold causes the piezo buzzer to emit a tone at a resonant frequency of the piezo buzzer, and each pulse width modulated input signal having a duty cycle less than the predefined threshold causes the piezo buzzer to emit one or more tones at a non-resonant frequency of the piezo buzzer.

In a further embodiment of any of the foregoing embodiments, for one of the distinct notifications of the first subset, the pulse-width modulated input signal has a varying duty cycle and the piezo buzzer provides an audio notification that varies in tone or volume.

In a further embodiment of any of the foregoing embodiments, one of the distinct notifications includes the piezo buzzer utilizing a pulse width modulated input signal and emitting three consecutive tones of increasing or decreasing pitch.

A method implemented by a smoke detector according to an example of the present disclosure includes providing a distinct notification for each of a plurality of modes of the smoke detector including at least one alarm mode that indicates detected smoke, at least one maintenance mode that indicates a maintenance condition of the smoke detector, and at least one network configuration mode. Each distinct notification includes one or more audio tones from a piezo buzzer, one or more illuminations of a single color visual indicator, or a combination thereof.

The embodiments, examples, and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
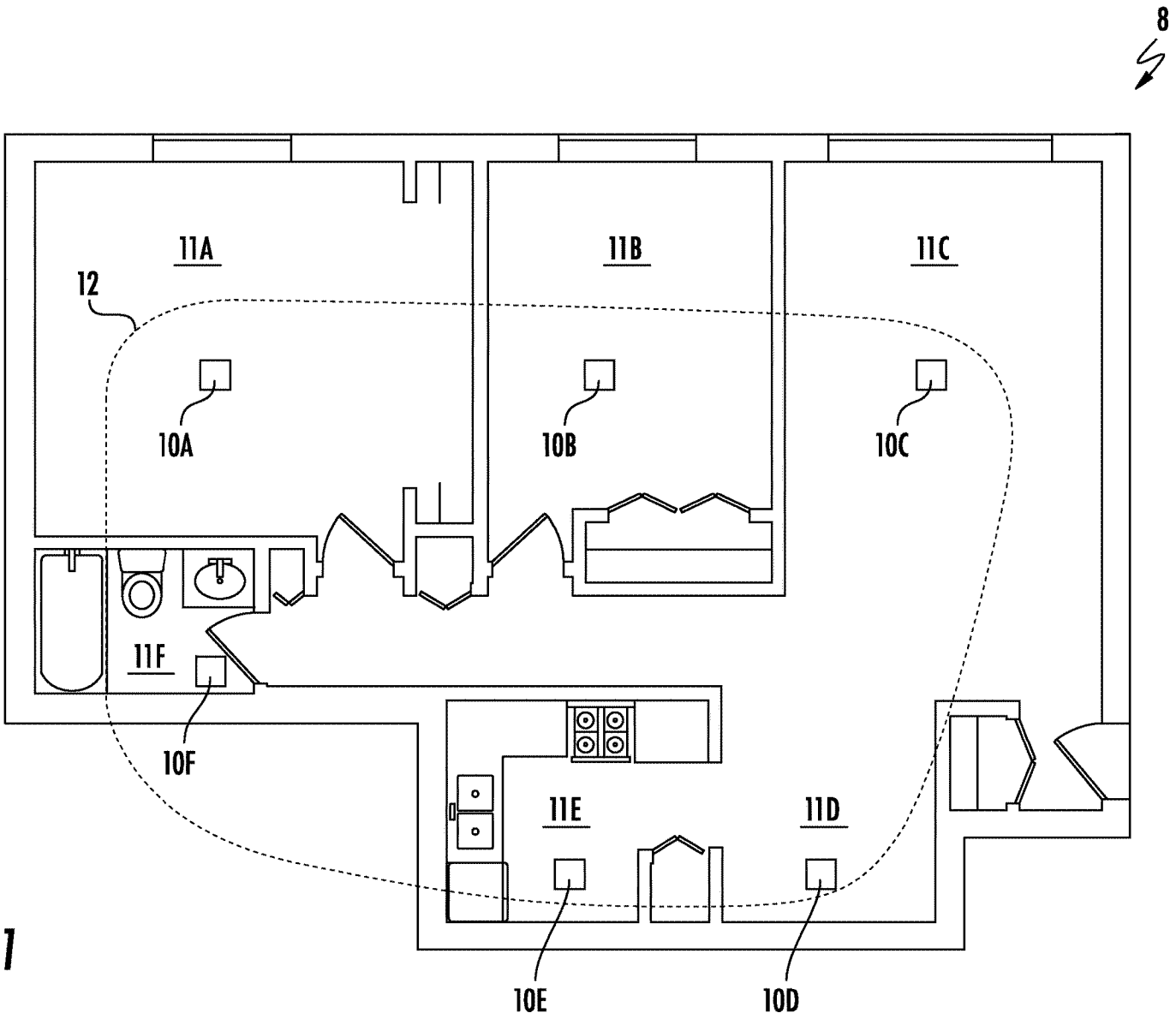
FIG. 1 is a schematic view of an example network group of smoke detectors.

FIG. 1 is a schematic view of an example building 8 in which a plurality of detectors 10A-F are distributed throughout various areas 11A-F. Each detector 10 corresponds to one of the areas 11 and is operable to detect smoke or another hazardous substance within its corresponding area 11. Although areas 11 as depicted may correspond to rooms in a building, in some embodiments multiple detectors 10A-N may be distributed within a single enclosed space such as area 11C and detector 10C and area 11D and detector 10D, or a single detector 10N may be operable to detect smoke within an area 11 that includes several rooms. In a typical embodiment, detectors 10A-F may be smoke detectors, but may in addition or in the alternative detect other hazardous or undesirable conditions or substances such as, for example, temperature deviations, carbon monoxide, dust or pollen. Smoke detectors are discussed below as an exemplary embodiment.

The plurality of smoke detectors 10A-F are networked together as a network group 12 and are operable to wirelessly communicate with each other. In one example, if any one of the smoke detectors 10 detects smoke, it will wirelessly communicate a condition to each of the smoke detectors 10 in the network group 12, and each will provide an audio notification and optionally also a visual notification of the detected smoke. This networked functionality makes it more likely that an individual will be alerted about a smoke detection event in the building 8, as the individual is more likely to be in proximity to a smoke detector 10 that is providing a notification regarding the smoke detection event than the individual would be if only the same detector 10 which detected smoke provided an audio notification and visual indication.

Within the network group 12, one of the smoke detectors 10 is configured as a coordinator, and the remaining ones of the smoke detectors 10 are configured as non-coordinators, or reduced function devices (RFDs). The coordinator smoke detector 10 provides a beacon signal to other members of the network group 12, and the non-coordinator smoke detectors 10 listen for and monitor the beacon signal, and use the presence or absence of the beacon signal to determine whether the network group 12 is still active.

In one example, the network group 12 can be either in a "closed" or an "opened" state, and new smoke detectors 10 can only be added to the network group 12 when it is in the open state. In one example, an existing network group 12 enters the opened state if an "open" request is received from a smoke detector 10 that is already part of the network group 12, but does not enter the open state if an open request is received from a smoke detector 10 that is not yet part of the network group 12 (e.g., a new smoke detector 10).

Figure 2:
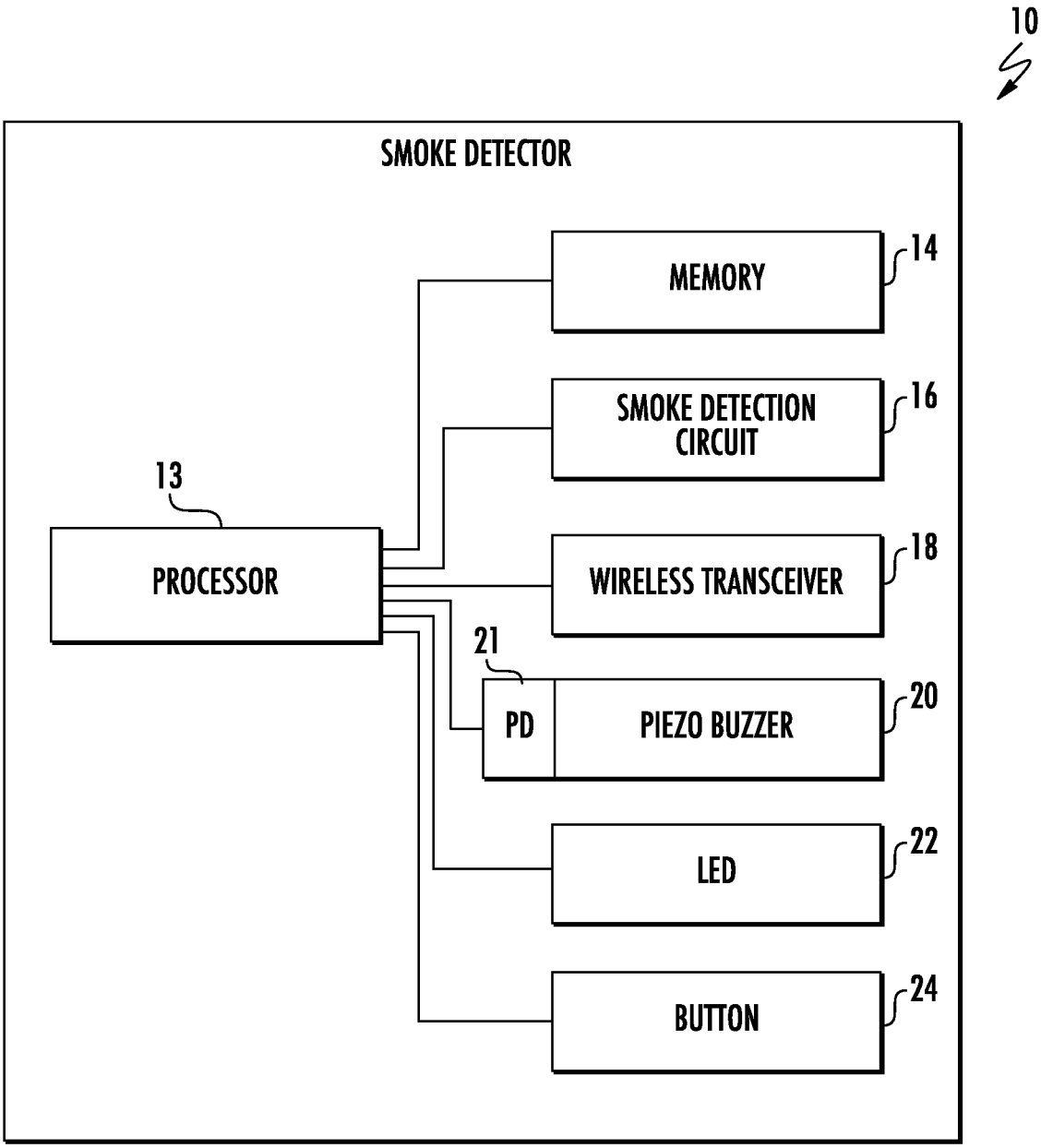
FIG. 2 is a schematic view of an example smoke detector from the network group.

FIG. 2 is a schematic view of an example smoke detector 10 that could be used in FIG. 1. The smoke detector 10 includes a processor 13 that is operatively connected to each of memory 14, a smoke detection circuit 16, a wireless transceiver 18, a piezo drive circuit 21 for a piezo buzzer 20, a light-emitting diode (LED) 22, and a push button 24. The smoke detector 10 provides a user interface which includes the push button 24 acting as an input device, and the piezo buzzer 20 and LED 22 acting as output devices.

The processor 13 may include one or more microprocessors, microcontrollers, application specific integrated circuits (ASICs), or the like, for example.

The memory 14 may include one or several types of memory such as read-only memory (ROM), random-access memory, cache memory, flash memory devices, optical storage devices, etc. In one non-limiting example, the processor 13 and memory 14 are incorporated into a single microcontroller integrated circuit. In one example, the memory 14 is configured to store a log of smoke detection events.

The smoke detection circuit 16 is operable to detect smoke, and could be a photoelectric or ionization-based detector, for example.

The wireless transceiver 18 is operable to transmit signals to and receive signals from other ones of the smoke detectors 10 within the group 12.

The piezo buzzer 20 is operable to provide a plurality of different audio notifications that vary in one or more of duration, interval between successive tones, pitch, and volume. The piezo drive circuit 21 is operable to cause the piezo buzzer 20 to emit sound based on an input signal from the processor 13.

The LED 22 is able to provide a plurality of visual indications that vary in one or more of duration of illumination and interval between illuminations. In some examples, the piezo buzzer 20 and LED 22 are configured to provide combined audio and visual indications. In one example, the LED 22 is able to illuminate in only a single color (e.g., red). In one example, a non-LED single color visual indicator is used instead of the LED 22.

The following are a plurality of example visual indications that the smoke detector 10 can be configured to provide using the LED 22:

- Half Hz—Continuously turning ON for 1 second and OFF for 1 second.
- Intermittent count—Outputs a predefined quantity of pulses followed by a pause, and then repetition. In one example, each pulse is 100 ms ON and 200 ms OFF, the predefined quantity is 3, and the pause is 1.5 seconds.
- Slow blink count—Predefined quantity of pulses with no repetition. In one example, each pulse is 400 ms ON and 600 ms OFF, and the predefined quantity is 4.
- Quick blink count—Predefined quantity of pulses with no repetition. In one example, each pulse is 100 ms ON and 500 ms OFF, and the predefined quantity is 4.

The button 24 is actuatable by a user to interact with and configure the smoke detector 10, and the processor 13 is configured to identify different types of actuation of the button 24.

The smoke detector 10 is configured to provide a plurality of distinct notifications that include sounds from the piezo buzzer 20. For a first subset of the plurality of distinct notifications, the processor 13 is configured to provide a respective pulse width modulated (PWM) input signal to the piezo drive circuit 21. For a second subset of the plurality of distinct notifications, the processor 13 is configured to provide a respective non-PWM input signal to the piezo drive circuit 21.

In one example, a non-PWM "on" signal from the processor 13 to the piezo drive circuit 21 having a duration that is greater than a predefined threshold (e.g., approximately 10 ms) causes the piezo buzzer 20 to emit sound at its resonant frequency, and a PWM input signal to the piezo drive circuit having a duty cycle that is less than the predefined threshold causes the piezo buzzer 20 to emit one or more softer tones at a non-resonant frequency of the piezo buzzer 20.

Figure 3C:
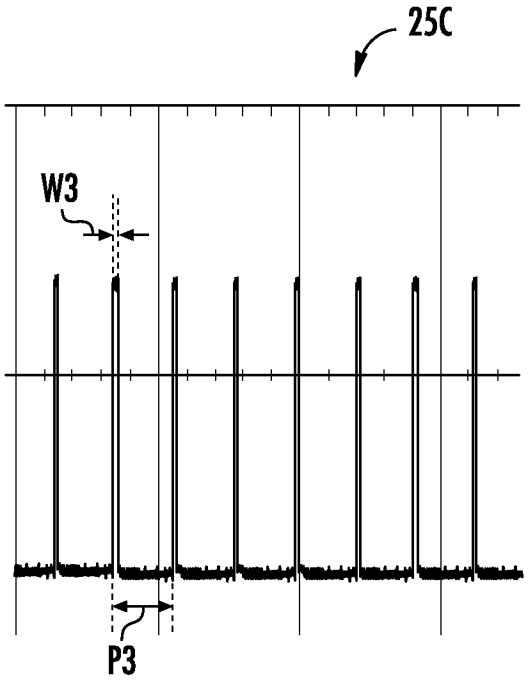
FIGS. 3A-C illustrate portions of an example pulse width modulated piezo buzzer input signal that utilizes a varying duty cycle.
Figure 3B:
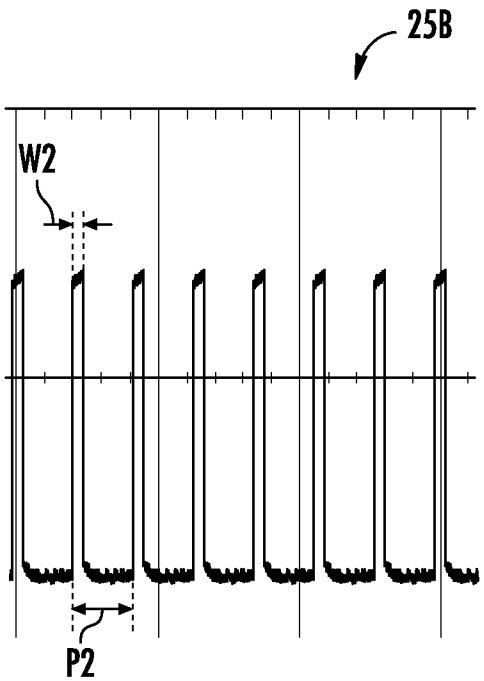
Figure 3A:
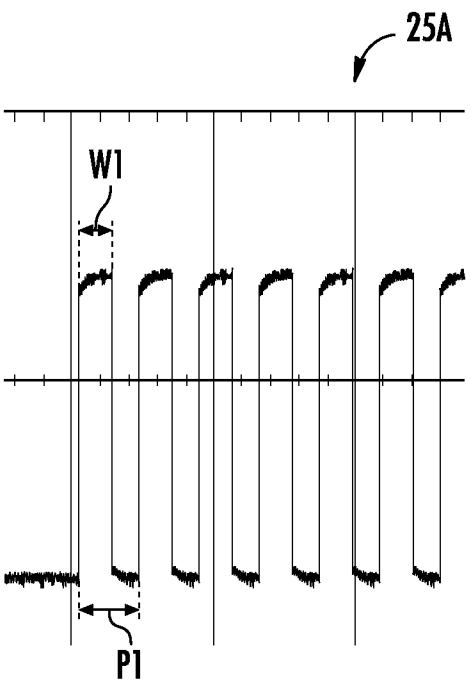

FIGS. 3A-C illustrate portions 25A-C of an example pulse width modulated piezo buzzer 20 input signal 25 that has a varying duty cycle. A duty cycle D refers to a ratio between a duration or width of a PWM pulse and a period T of a rectangular PWM waveform input signal. A duty cycle of 50% provides the most volume, and decreasing the duty cycle (i.e., below 50%) provides for a decreased volume. By providing PWM input signals to the piezo drive circuit 21 schematically illustrated in FIG. 2, the processor 13 is able to provide a plurality of different tones from the piezo buzzer 20.

In one example, the input signal provided to the piezo drive circuit 21 exhibits a varying duty cycle and provides a corresponding audio notification from the piezo buzzer 20 that varies in tone or volume.

With further reference to FIGS. 3A-C, portion 25A has a period P1, a pulse width W1, and duty cycle D1=W1/P1. Portion 25B has a period P2, a pulse width W2, and a duty cycle D2=W2/P2. Portion 25C has a period P3, a pulse width W3, and a duty cycle D3=W3/P3. D1 is greater than D2, and D2 is greater than D3. The input signal 25 of FIGS. 3A-C can be provided to the piezo drive circuit 21, causing the piezo buzzer 20 to emit a "sonar sound" that has a decaying tone that emulates that of a sonar ping.

Another example notifications from the smoke detector 10 includes the piezo buzzer 20 utilizing a PWM input signal and emitting three or more consecutive tones of increasing or decreasing pitch (a "twiddle" sound).

The following are a plurality of example audio notifications that the smoke detector 10 may provide using the piezo buzzer 20, along with an indication of whether they are based on PWM or non-PWM input signals:

- T3 Sound—(non-PWM)—Temporal pattern for a smoke alarm (also known as the "Temporal Three" pattern or "Audible Emergency Evacuation Signal" and as defined by ANSI S3.41-1990). The T3 sound is provided at a resonant frequency of the piezo buzzer 20 in one example. The LED 22 may also be illuminated in synchronization with the T3 sounds of the piezo buzzer 20. In one example, the smoke detector 10 provides the T3 alarm by repeatedly cycling between the piezo buzzer 20 being on for 0.5 seconds and off for 0.5 seconds.
- Chirp/Beep count—(non-PWM)—Quick count of short beeps. The LED 22 may also be also used with this pattern. In one example, each "chirp" tone has a duration of approximately 20 ms at resonant frequency of the piezo buzzer 20.
- Sonar—(PWM)—decaying tone sound, similar to a sonar ping (as described above).
- Twiddle—(PWM)—Three contiguous short tones of increasing or decreasing frequency (as described above).
- Network join error—(PWM)—Low frequency and non-harmonic tone (i.e., at non-resonant frequency of piezo buzzer 20).
- Wireless transceiver error—(PWM)—Sound alternating between two contiguous low frequency and non-harmonic tones having different pitches, and the tones are repeated (e.g., for 5 seconds).

Referring again to FIG. 2, the processor 13 is configured to identify different types of actuation of the button 24. In particular, the processor is configured to interpret each of the following types of actuation:

- Single press—Single continuous actuation of the button 24 having a duration less than a predefined time period.
- Double press—Two successive actuations of the button 24 within the predefined time period.
- Long press—Single continuous actuation of the button 24 having a duration longer than the predefined time period.

In one example, the predefined time period is approximately 1.5 seconds. In one example, the processor 13 is configured to interpret more than two actuations of the button 24 within the predefined time period as a "long press", based on an assumption that the user meant to perform a long press but did not press the button 24 down strongly enough. In one example, the processor 13 uses a debouncing feature, which is understood by those of ordinary skill in the art, to filter out the noise associated with a button actuation and more accurately identify when and how long the button 24 was actuated.

Figure 4:
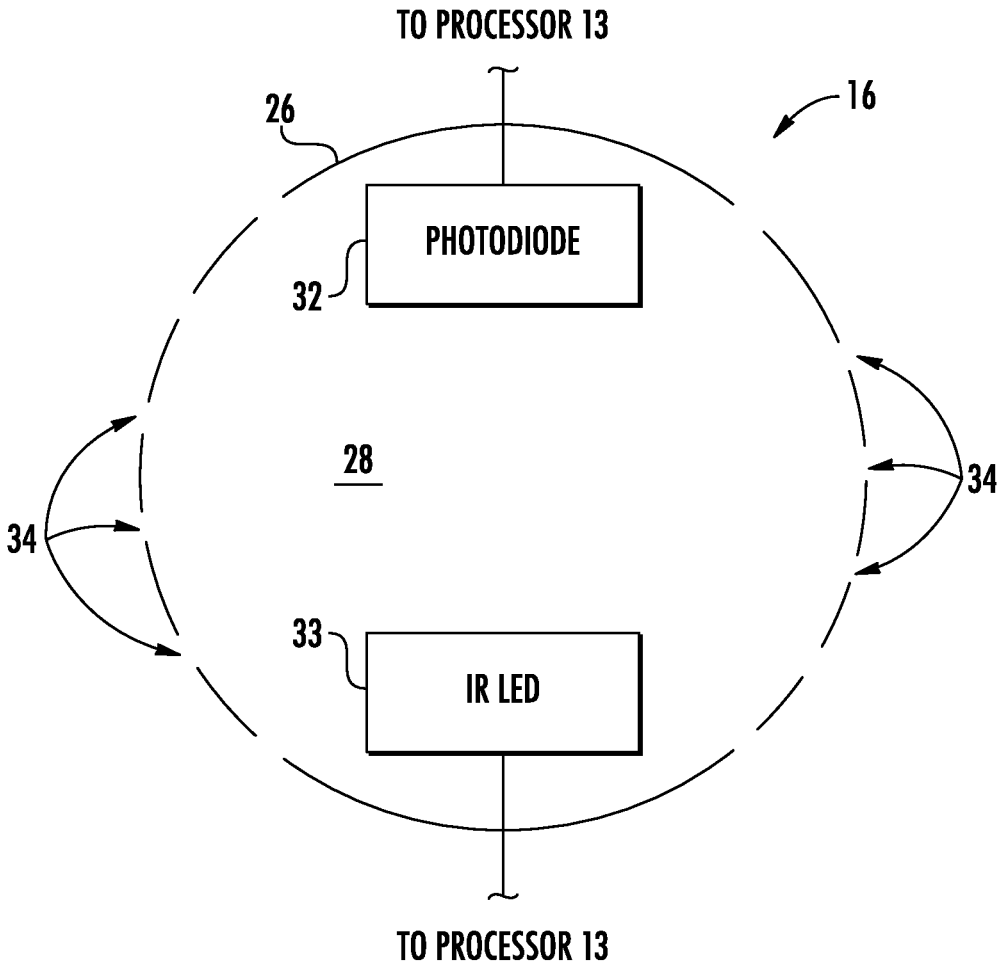
FIG. 4 schematically illustrates an example photoelectric smoke detection circuit.

FIG. 4 schematically illustrates an example in which the smoke detection circuit 16 is a photoelectric smoke detection circuit that includes an outer wall 26 that defines a chamber 28. An infrared (IR) LED 33 and a photodiode 32 are disposed in the chamber 28. The outer wall 26 includes a plurality of openings 34 that allow smoke to enter the chamber 28. The IR LED 33 emits light, and the photodiode 32 detects that light. The processor 13 is operable to detect the presence of smoke in the chamber 28 based on a change in the intensity of the light from the IR LED 33 that is detected by the photodiode 32.

In one example, the processor 13 is configured to gradually increase an intensity of the light emitted by the IR LED 33 over time to compensate for a decline in the output of the IR LED 33 under non-smoke conditions. In one such example, the memory 14 is configured to store a log of the compensation values.

Referring again to FIG. 2, the smoke detector 10 includes a plurality of different operating modes, including any combination of the following:

- a standby mode;
- alarm mode(s) for indicating smoke detected by the smoke detector 10 or another smoke detector in its network group 12;
- fatal fault mode(s) for indicating a fault condition detected by the smoke detector 10 where the smoke detector is no longer operational;
- non-fatal fault mode(s), for indicating a fault condition detected by the smoke detector 10, where the smoke detector is likely to be operational but needs to be replaced;
- maintenance mode(s) for indicating a maintenance condition of the smoke detector 10 (e.g., near end of life, photo compensation near end of usable range);
- network configuration mode(s) for indicating a status of a network group 12 and/or a status of the smoke detector 10 within a network group 12; and
- manufacturing mode(s) for use during manufacture of the smoke detector 10 and for indicating a status of a calibration process of the smoke detector 10 (e.g., a smoke calibration process).

The processor 13 is operable to provide distinct notifications for each of the plurality of modes of the smoke detector 10. Each notification includes one or more audio tones from the piezo buzzer 20, one or more illuminations of the LED 22, or a combination thereof. Different ones of the distinct notifications utilize different intervals between successive audio tones, different intervals between successive illuminations of the LED, or both. Some example notifications may emit sound from piezo buzzer 20 and illuminate the LED 22 in unison with each other.

A plurality of example non-fatal fault modes and example associated notifications for the non-fatal modes are shown in Table 1 below.

TABLE 1

| Non-fatal Fault Mode | Notification |
|---|---|
| End of life | 2 chirps every 30 seconds |
| Low battery warning | One blink and chirp every 60 seconds |
| Low battery | Blink every 30 seconds |

In one example, the smoke detector 10 has an expiry date, and the processor 13 includes a timer to determine whether the smoke detector 10 has reached the expiry date. The "end of life" non-fatal fault mode above indicates that the expiry date of the smoke detector 10 has been reached. In the example of Table 1, the notification for the "end of life" non-fatal fault mode is two chirps from the piezo buzzer 20 every thirty seconds.

The "low battery warning" non-fatal fault mode indicates that a battery level of a battery (not shown) that powers the smoke detector 10 has fallen below a first threshold. The example notification for "low battery warning" is one blink and one chirp every sixty seconds.

The "low battery" non-fatal fault mode indicates that the battery level has fallen below a second threshold that is lower than the first threshold. The example notification for "low battery" is one blink every thirty seconds.

In one example, the notifications for the non-fatal fault modes can be hushed by actuation of the button 24 (e.g., a single press).

Figure 5:
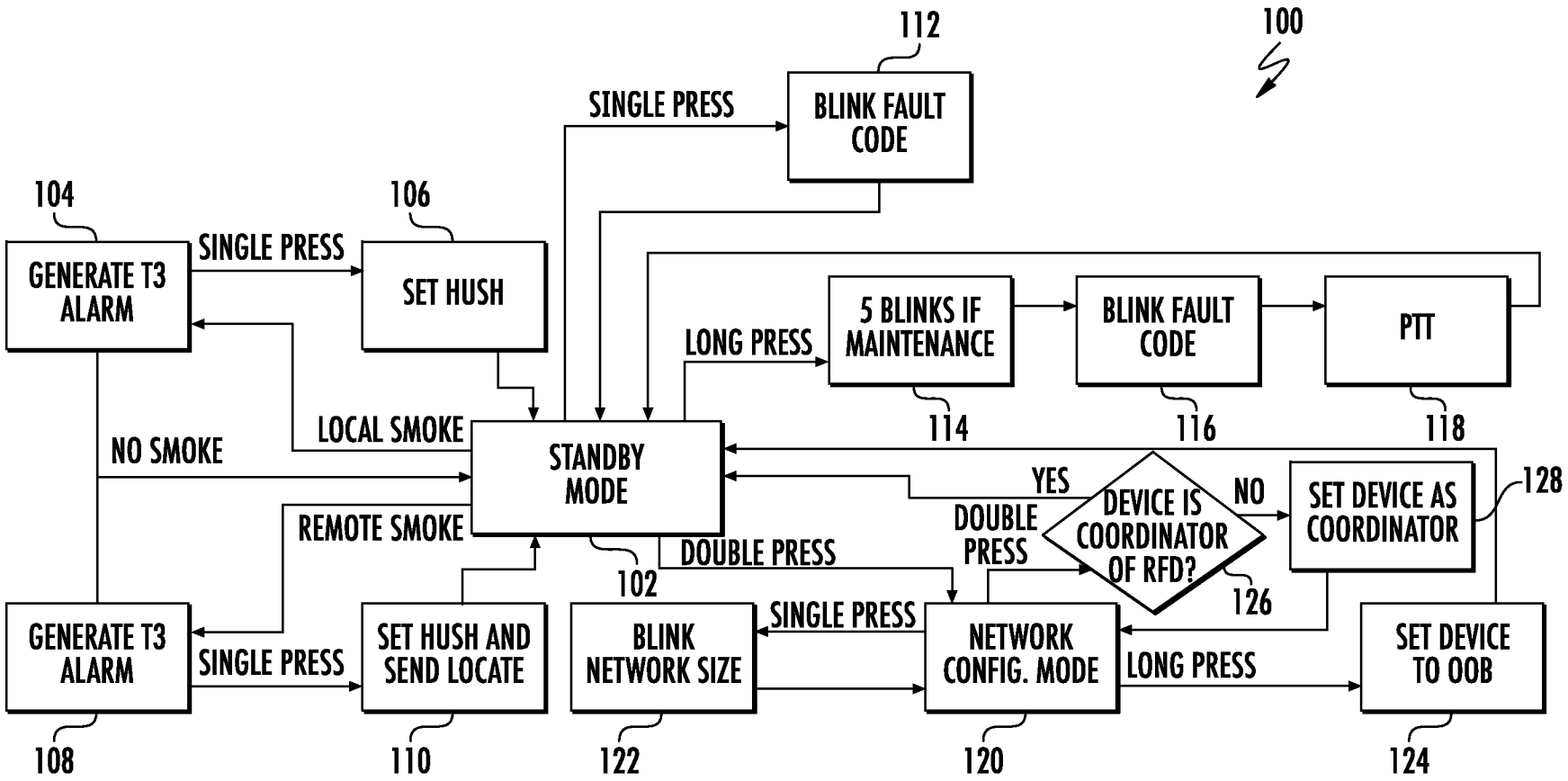
FIG. 5 is a flowchart of an example method of operation for a smoke detector.

FIG. 5 is a flowchart 100 of an example method of operation of the smoke detector 10. As shown in FIG. 5, the processor 13 is configured to perform one of a plurality of predefined actions in response to actuation of the button 24, based on a type of the actuation and which of the plurality of operating modes the smoke detector 10 is in when the actuation is detected.

The smoke detector 10 is in a standby mode by default (block 102). If smoke is locally detected ("local smoke" in FIG. 5), the smoke detector 10 generates a smoke alarm (block 104), such as the T3 alarm. If smoke ceases to be locally detected, the smoke detector 10 returns to the standby mode (block 102). If a single press of the button 24 is detected during the local smoke event (block 104), the smoke detector 10 hushes its alarm (block 106) and returns to standby mode (block 102). In one example, the hushing is temporal (i.e., temporary and lasting a predefined time period, such as 10 minutes).

Similar behavior occurs if a remote smoke detector 10 in the network group 12 detects smoke ("remote smoke" in FIG. 5). In that case, each smoke detector in the network group 12 generates a smoke alarm (e.g., the T3 alarm) (block 108) and the smoke detector 10 returns to standby mode if smoke ceases to be detected. In one example, if a single press of the button 24 is detected during the remote smoke event (block 108), the smoke detector 10 sends a locate signal that temporally hushes all smoke detectors 10 in the network group 12 except the one that locally detected smoke (block 110).

Table 2 below summarizes some of the example alarm modes discussed above and their associated example notifications. In Table 2, and elsewhere, a "blink" refers to a blink of the LED 22.

TABLE 2

| Alarm Mode | Notification |
|---|---|
| Smoke alarm (remote or local) (block 104 or 108) | T3 alarm pattern |
| Smoke alarm hushed (block 102 and hush active) | Blink once every 10 seconds |

If a single press of the button 24 is detected and the smoke detector 10 has a fatal fault condition to report, the LED 22 blinks a fault code corresponding to the fatal fault condition (block 112), with the quantity of blinks being indicative of a corresponding fault code. A plurality of example fatal fault conditions and associated fault error codes are shown in Table 3 below.

TABLE 3

| Fatal Fault Condition | Error Code (blinked by LED 22) |
|---|---|
| Push-to-test failure | 7 |
| Memory failure | 8 |
| End of Life | 9 |
| Photo chamber supervision | 10 |
| Photo compensation | 14 |

The "push-to-test failure" fault indicates that a recent button-initiated test of the smoke detector 10 (i.e., a "push-to-test") has failed, and in the example of Table 3 has an associated error code of 7 (yielding 7 blinks if applicable during block 112). The "memory failure" fault indicates that a fault has been detected with memory 14.

As discussed above, the processor 13 includes a timer to determine the life of the smoke detector 10. The "end of life" fault indicates that the life of the smoke detector 10 has arrived, and the smoke detector 10 is considered expired.

The "photo chamber supervision" fault indicates that the measurements of the photodiode 32 appear inaccurate to the processor 13 (e.g., by deviating by more than an expected amount from normal standby mode non-smoke measurements).

The "photo compensation" fatal fault relates to the IR LED 33 compensation feature discussed above, and indicates that the smoke detection circuit 16 has reached the limit of what it can compensate for. This may occur, for example, if the IR LED 33 has either deteriorated to a certain extent or dust has built up within the chamber 28, preventing the photodiode 32 from being able to sufficiently detect light from the IR LED 33 under non-smoke conditions.

Table 4 below summarizes two example fatal fault modes and their associated example notifications.

TABLE 4

| Fatal Fault Mode | Notification |
|---|---|
| Fatal Fault detected | Blink every 10 seconds and chirp every 30 seconds |
| Fault code requested (block 112) | Blink error code |

As described above, the smoke detector 10 may be operable to provide fatal fault condition notifications based on a "single press." In one example, the smoke detector may be operable to provide fault condition notifications autonomously as well, once they are detected.

Referring again to block 102, if a long press of the button 24 is detected, if the smoke detector 10 is experiencing a maintenance condition (e.g., near end of life, photo compensation near end of usable range), the smoke detector 10 enters a maintenance mode in which the LED 22 blinks five time to indicate that the smoke detector 10 is experiencing the maintenance condition (block 114).

In one example, the smoke detector 10 has an expiry date, and the processor 13 includes a timer to determine whether the smoke detector 10 is close to reaching (i.e., within a predefined threshold of) the expiry date. The "Near end of life" maintenance condition corresponds to the expiry date of the smoke detector 10 being within a predefined time period of arrival (e.g., within months or weeks of the expiration)

In one example, the "Near end of photo compensation" maintenance condition relates to the IR LED 33 compensation feature discussed above, and corresponds to the smoke detection circuit 16 being near to reaching the limit of what it can compensate for.

Referring again to block 114 of FIG. 5, if the smoke detector 10 is not experiencing a maintenance condition, the smoke detector 10 does not enter the maintenance mode, and block 114 is bypassed.

If the smoke detector 10 is experiencing a fatal fault condition, the fault code corresponding to the experienced fault is blinked (block 116). Otherwise, if the smoke detector 10 is not experiencing a fatal fault condition, block 116 is bypassed.

The smoke detector then conducts a push-to-test (PTT) procedure (block 118) in which the smoke detection circuit 16 and piezo buzzer 20 are tested, and the smoke detector returns to standby mode (block 102).

From standby mode, if a double press of the button 24 is detected, the smoke detector enters a network configuration mode (block 120) during which the smoke detector 10 either looks for a network group 12, or if already present in a network group 12, the network group 12 is "opened", and every device in the network group 12 indicates its status in the network group 12 as either coordinator or non-coordinator. In one example, additional devices can be added to the network only when the network group 12 is an "opened" state.

If a single press of the button 24 is detected from block 120, the smoke detector 10 blinks the LED 22 a quantity of times corresponding to a quantity of smoke detectors in the network group 12 (block 122), and returns to block 120.

If a long press of the button 24 is detected from block 120, the smoke detector 10 resets its network settings to an out-of-box (00B) state (block 124), and returns to the standby mode 102.

If a double press of the button 24 is detected from the block 120, the smoke detector 10 determines whether it is the coordinator in its network group 12 (block 126). If the smoke detector 10 is already coordinator, the smoke detector 10 returns to standby mode (block 102) and the network group 12 is "closed". Otherwise, the smoke detector becomes the coordinator of its network group 12 (block 128).

A plurality of example network configuration modes and their associated notifications are shown in Table 5 below.

TABLE 5

| Network Configuration Mode | Notification |
|---|---|
| Smoke detector is looking for a network group 12 | Blink 1 second on, and 1 second off while looking |
| A device opened the network | Sonar sound |
| Smoke detector is a coordinator in a network group 12 | LED intermittent count 2 |
| Smoke detector is a non-coordinator in a network group 12 | LED intermittent count 3 |
| Smoke detector is transitioning to OOB status | 4 quick blinks every 2 seconds twice |
| Smoke detector indicating size of its network group | Slow blink the number of smoke detectors in the network |
| A remote non-coordinator smoke detector joined the network group 12 | Twiddle sound |
| Smoke detector unable to find an existing network group, or a single device to create a network group with | Network join error sound |
| Smoke detector lost its network group | Blink and chirp every 30 seconds |
| Remote Fatal Faults or Remote Low Battery | Chirp every 4 hours |

Table 6 below summarizes a plurality of example miscellaneous modes and their associated notifications.

TABLE 6

| Miscellaneous Mode | Notification |
|---|---|
| Power up and processor 13 unable to communicate with wireless transceiver 18 | Wireless transceiver error sound |
| Standby | None (no blinks or chirps) |

Table 7 below summarizes a plurality of example manufacturing modes and their associated example notifications that may be used by a technician during manufacturing of the smoke detector 10.

TABLE 7

| Mode | Notification |
|---|---|
| Smoke calibration begin | Series of rapid blinks |
| Smoke calibration Process | Blink 1 second On, 1 second Off |
| Smoke calibration completed successfully | LED off |
| Smoke calibration failure | LED on |
| Waiting for final test of wireless transceiver 18 | LED on |

The smoke detector 10 is able to provide for a rich user interface using three basic components: piezo buzzer 20, LED 22, and button 24, without requiring more complex hardware, such as multiple buttons, a speaker for sound or voice feedback, and multiple LEDs and/or multi-color LEDs. This reduces cost and complexity as compared to devices which do include additional complex hardware.

Although example embodiments have been disclosed, a worker of ordinary skill in this art would recognize that certain modifications would come within the scope of this disclosure. For that reason, the following claims should be studied to determine the scope and content of this disclosure.

What is claimed is:

1. A smoke detector comprising:

a smoke detection circuit operable to detect smoke;

a piezo buzzer;

a single color visual indicator;

a transceiver operable to communicate with at least one other smoke detector; and a processor operatively connected to the smoke detection circuit, piezo buzzer, single color visual indicator, and transceiver, and operable to provide distinct notifications for each of a plurality of modes of the smoke detector including at least one alarm mode that indicates detected smoke, at least one maintenance mode that indicates a maintenance condition of the smoke detector, and at least one network configuration mode, each distinct notification comprising one or more audio tones from the piezo buzzer, one or more illuminations of the single color visual indicator, or a combination thereof;

wherein the network configuration mode includes a first distinct notification for indicating whether the smoke detector is part of a network group, and at least one second distinct notification for indicating whether the smoke detector has a coordinator role or a non-coordinator role within the network group.

2. The smoke detector of claim 1, wherein different ones of the distinct notifications utilize different intervals between successive audio tones, different intervals between successive illuminations of the single color visual indicator, or both.

3. The smoke detector of claim 1, wherein the distinct notification corresponding to one of the at least one alarm modes indicates detection of smoke by either of the smoke detection circuit or the at least one other smoke detector.

4. The smoke detector of claim 3, wherein:

a plurality of the distinct notifications include one or more sounds from the piezo buzzer; and the processor is configured to provide a respective pulse width modulated input signal to the piezo buzzer for each of a first subset of the plurality of distinct notifications, and provide a respective non-pulse width modulated input signal to the piezo buzzer for each of a second subset of the plurality of distinct notifications.

5. The smoke detector of claim 4, wherein:

each non-pulse width modulated input signal having an "on" duration greater than a predefined threshold causes the piezo buzzer to emit a tone at a resonant frequency of the piezo buzzer; and each pulse width modulated input signal having a duty cycle less than the predefined threshold causes the piezo buzzer to emit one or more tones at a non-resonant frequency of the piezo buzzer.

6. The smoke detector of claim 4, wherein one of the distinct notifications comprises the piezo buzzer utilizing a pulse-width modulated input signal having a varying duty cycle and providing an audio notification that varies in tone or volume.

7. The smoke detector of claim 4, wherein one of the distinct notifications comprises the piezo buzzer utilizing a pulse-width modulated input signal and emitting three consecutive tones of increasing or decreasing pitch.

8. The smoke detector of claim 1, comprising:

a button;

wherein based on actuation of the button, the processor is configured to:

determine a type of actuation of the button; and perform one of a plurality of different predefined actions in response the type of actuation and which mode the smoke detector is in when the actuation is detected.

9. The smoke detector of claim 8, wherein the processor is configured to:

interpret a single continuous actuation of the button having a duration shorter than a predefined time period as a first type of actuation;

interpret two successive actuations of the button within the predefined time period as a second type of actuation; and interpret a continuous actuation of the button having a duration longer than the predefined time period as a third type of actuation.

10. The smoke detector of claim 9, wherein the processor is configured to interpret more than two actuations of the button within the predefined time period as the third type of actuation.

11. The smoke detector of claim 8, wherein when the smoke detector is networked with the at least one other smoke detector in a network group:

one of the smoke detectors in the network group is configured as a coordinator of the group that provides a beacon signal to other members of the network group; and the remaining smoke detectors in the group are configured as non-coordinators in the network group that monitor the beacon signal.

12. The smoke detector of claim 11, wherein when the smoke detector is part of a network group and is in one of the network configuration modes, the processor is configured to:

provide a first one of the distinct notifications that indicates a quantity of smoke detectors that are members of the network group in response to a first type of actuation of the button;

cause the smoke detector to become the coordinator of the network group and provide a second one of the distinct notifications that indicates that the smoke detector has become the coordinator in response to a second type of actuation of the button; and reset a network configuration of the smoke detector in response to a third type of actuation of the button.

13. The smoke detector of claim 1, wherein the plurality of modes includes fatal and non-fatal fault modes in which the smoke detector provides one of the distinct notifications to indicate a fault condition.

14. The smoke detector of claim 13, wherein in the fatal fault mode, a quantity of blinks of the light indicates a corresponding fault code of the smoke detector.

15. The smoke detector of claim 1, wherein the plurality of modes includes a manufacturing mode in which the smoke detector provides one of the distinct notifications to indicate a status of a manufacturing calibration process of the smoke detector.

16. A smoke detector comprising:

a smoke detection circuit operable to detect smoke;

a piezo buzzer; and a processor connected to the smoke detection circuit and piezo buzzer and operable to provide distinct notifications for each of a plurality of modes of the smoke detector, including at least one alarm mode that indicates detected smoke and at least one non-alarm mode, each notification comprising one or more audio tones from the piezo buzzer;

wherein the processor is configured to provide a respective pulse width modulated input signal to the piezo buzzer for each of a first subset of the plurality of distinct notifications, and provide a respective non-pulse width modulated input signal to the piezo buzzer for each of a second subset of the plurality of distinct notifications.

17. The smoke detector of claim 16, wherein:

each non-pulse width modulated input signal having an "on" duration greater than a predefined threshold causes the piezo buzzer to emit a tone at a resonant frequency of the piezo buzzer; and each pulse width modulated input signal having a duty cycle less than the predefined threshold causes the piezo buzzer to emit one or more tones at a non-resonant frequency of the piezo buzzer.

18. The smoke detector of claim 15, wherein for one of the distinct notifications of the first subset, the pulse-width modulated input signal has a varying duty cycle and the piezo buzzer provides an audio notification that varies in tone or volume.

19. The smoke detector of claim 16, wherein one of the distinct notifications comprises the piezo buzzer utilizing a pulse width modulated input signal and emitting three consecutive tones of increasing or decreasing pitch.

20. A method implemented by a smoke detector, comprising:

providing a distinct notification for each of a plurality of modes of the smoke detector including at least one alarm mode that indicates detected smoke, at least one maintenance mode that indicates a maintenance condition of the smoke detector, and at least one network configuration mode, each distinct notification comprising one or more audio tones from a piezo buzzer, one or more illuminations of single color visual indicator, or a combination thereof;

the network configuration mode includes a first distinct notification for indicating whether the smoke detector is part of a network group, and at least one second distinct notification for indicating whether the smoke detector has a coordinator role or a non-coordinator role within the network group.

* * * * *